United States Patent [19]

Carter

[11] 4,095,231

[45] June 13, 1978

[54] BASE STATION ANTENNA

[75] Inventor: Larry D. Carter, Anderson, S.C.

[73] Assignee: True Temper Corporation, Cleveland, Ohio

[21] Appl. No.: 749,714

[22] Filed: Dec. 10, 1976

[51] Int. Cl.[2] ..... H01Q 1/48; H01Q 9/34

[52] U.S. Cl. ..... 343/846; 343/874; 343/900; 343/888

[58] Field of Search ..... 343/828, 830, 848, 874, 343/890, 891, 846, 888, 892, 900

[56] References Cited

U.S. PATENT DOCUMENTS

| | | | |
|---|---|---|---|
| 2,184,729 | 12/1939 | Bailey | 343/830 |
| 2,681,412 | 6/1954 | Webster | 343/900 |
| 2,938,210 | 5/1960 | Harris | 343/900 |
| 3,071,771 | 1/1963 | Scheldorf | 343/828 |
| 3,259,901 | 7/1966 | Bykerk | 343/848 |

FOREIGN PATENT DOCUMENTS

| | | | |
|---|---|---|---|
| 842,533 | 7/1960 | United Kingdom | 343/846 |

OTHER PUBLICATIONS

*The A.R.R.L. Antenna Book*, American Radio Relay League, Inc., Newington, Conn., 1970, pp. 203–206.

*The Radio Amateur's Handbook*, American Radio Relay League, Inc., Newington, Conn., 1972, p. 591.

*Primary Examiner*—Alfred E. Smith
*Assistant Examiner*—Harry E. Barlow
*Attorney, Agent, or Firm*—J. H. Slough

[57] ABSTRACT

A base station radio antenna comprising a bracket having a first section for attachment to a support structure and a second section for receiving antenna whips, an antenna whip extending upwardly from a central opening in the second section of the bracket, and a plurality of antenna whips inclined relative to the upwardly extending antenna whip and extending generally downwardly from openings in the second section spaced radially from, and equi-angularly around, the central opening.

9 Claims, 6 Drawing Figures

BASE STATION ANTENNA

The present invention relates to the construction of antennas, and in particular, to the construction of one-half wavelength base station radio antennas such as those used for transmitting and receiving citizens band radio signals.

Various antenna construction for base station radio antennas are known in the art. Such antennas are generally intended to receive and transmit radio signals over a frequency range, and to do so with a minimum amount of distortion. Furthermore, such antennas should be capable of withstanding physical loads to which they may be subjected, and economical to manufacture. Despite various efforts in this direction, such antennas have tended to be relatively expensive, and the provision of a relatively inexpensive base station antenna which meets the foregoing electrical and physical criteria would be an important advancement in the art.

Antenna constructions which exemplify antennas known in the art are disclosed in the following U.S patents: U.S. Pat. Nos. 2,419,538; 3,259,901; 3,513,615; 3,579,244; 3,587,109; and 3,665,478. In addition, base station antennas are known which include an elaborate central mounting member from which extends a vertical fiberglass antenna whip, and a set of downwardly inclined fiberglass antenna whips equally spaced around the vertical whip. In addition, base station antennas are known which include support bracket assemblies from which extend antenna whips of varying orientations and constructions. As indicated above, the latter constructions are generally complicated devices.

An object of the present invention is to provide an improved base station antenna.

Another object of the invention is to provide an improved antenna of the foregoing type which is capable of receiving and transmitting radio signals substantially free of distortion.

Still another object of the present invention is the provision of an improved antenna of the foregoing type which is capable of withstanding physical loads to which such antenna would normally be subjected when mounted in an outdoor location.

An additional object of the present invention is to provide an antenna of the foregoing types which is economical to manufacture, and effective and efficient to use.

Other objects will be apparent from the description to follow and from the appended claims.

A base station antenna according to the present invention comprises a bracket having a first section for attachment to an external support and a second section having a central opening and a plurality of other openings spaced radially about the central opening; a first antenna whip extending in one direction from one side of the second section from the central opening; and a plurality of second antenna whips extending in the opposite direction from the opposite side of the second section from the other openings and inclined outwardly from the axis of the first antenna whip.

Referring now to the drawings wherein like reference numbers designate like parts:

A base station antenna according to the preferred embodiment of the invention described below comprises a unitary, metal support bracket having a generally vertical section contoured for attachment to a vertical support mast and a generally horizontal section having a central opening and a set of radially disposed, equi-angularly spaced other openings; a vertical, fiberglass antenna whip extending upwardly from the central opening; and a set of downwardly extending antenna elements secured in the other openings. The horizontal section of the bracket is configured to render the downwardly extending elements outwardly inclined from the longitudinal axis of the upward whip. A coaxial cable is secured to the antenna with the inner conductive portion electrically connected to the upper whip and the conductive sheath electrically connected to the lower whips.

Figure 1:
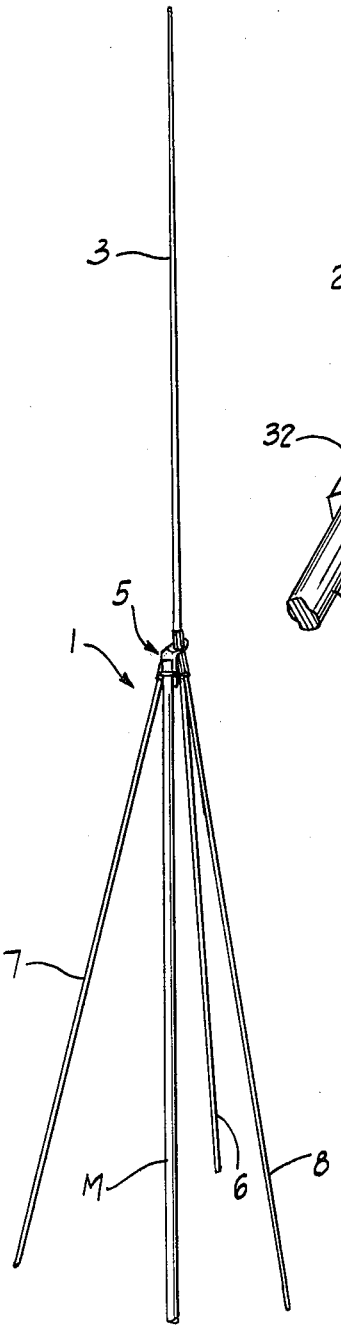
FIG. 1 is a perspective view of a base station antenna according to the invention.

Turning now to FIG. 1, a one-half wavelength, center-fed, dipole base station radio antenna 1 is illustrated. Antenna 1 comprises an upper, vertically upstanding whip or element 3 having a base portion secured to a support bracket 5, and three lower antenna whips 6, 7 and 8 extending generally downwardly from support bracket 5 to which they are secured. The antenna is attached to a vertical support mast M.

Figure 2:
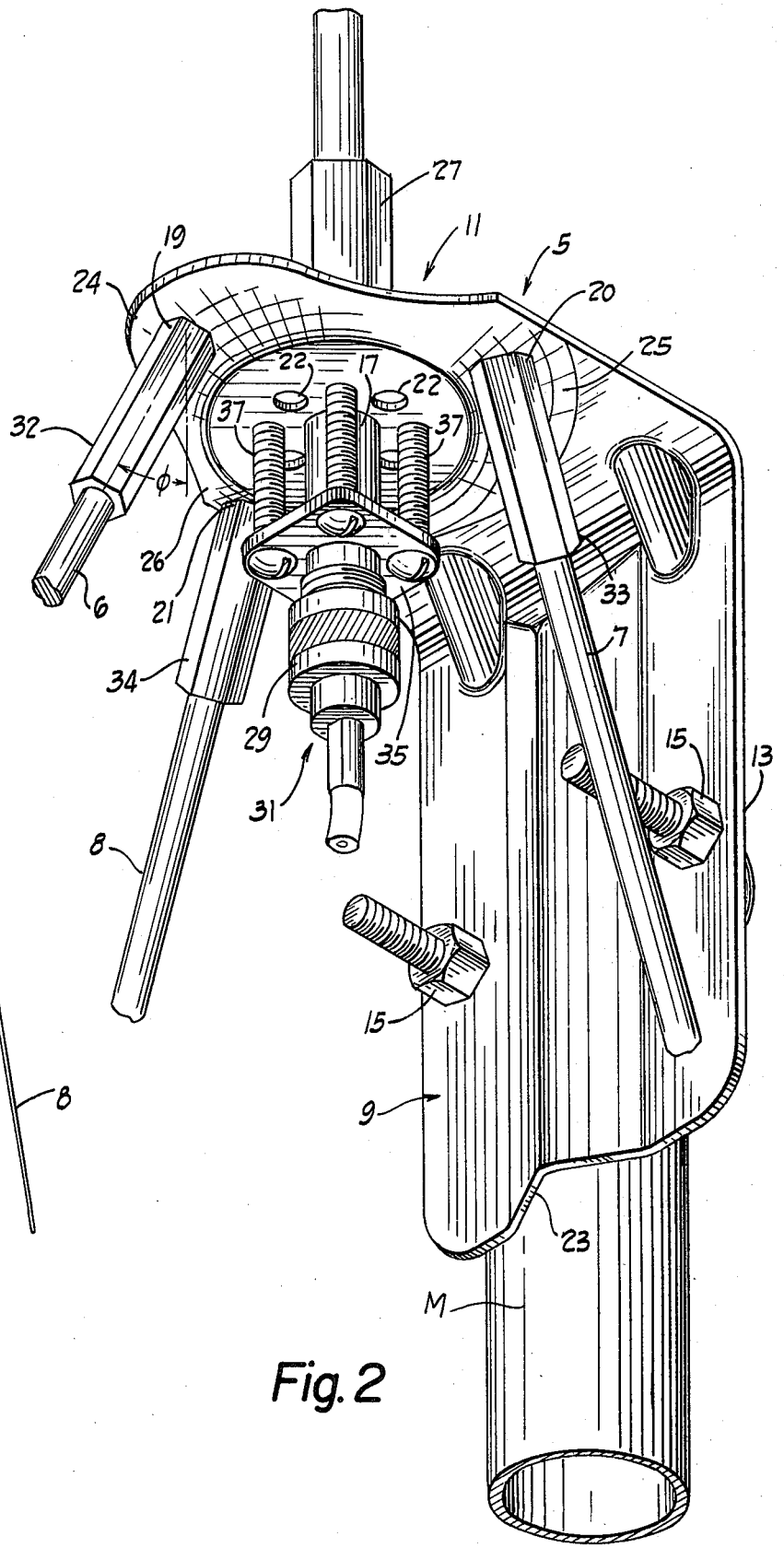
FIG. 2 is a detailed perspective view of a central portion of the antenna shown in FIG. 1, depicting the connection between various components of the antenna.
Figure 3:
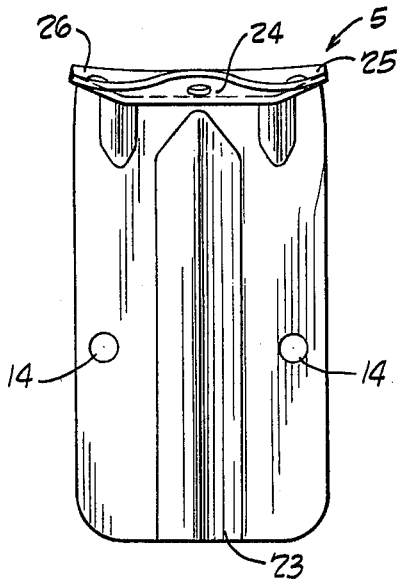
FIG. 3 is a front plan view of the support bracket of the antenna shown in FIGS. 1 and 2.
Figure 4:
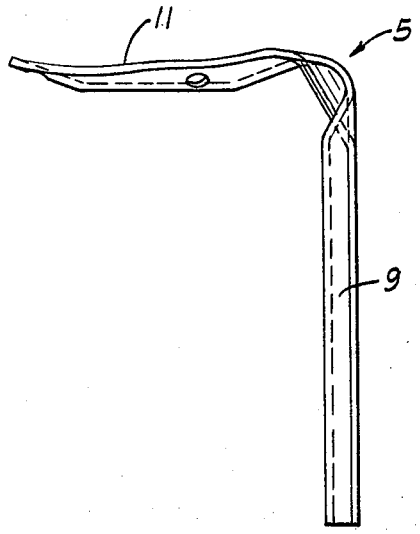
FIG. 4 is a side plan view of the support bracket shown in FIG. 3.
Figure 6:
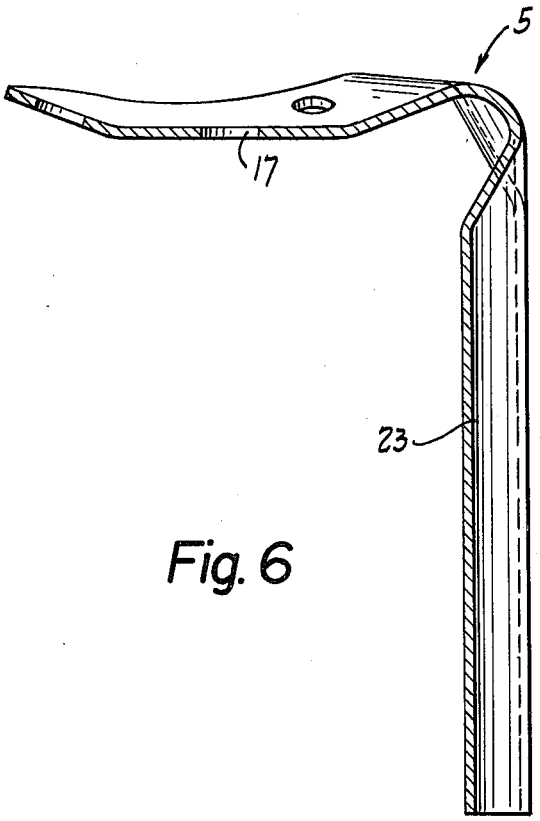
FIG. 6 is a view taken in the direction 6—6 indicated by the arrows in FIG. 3.

Referring next to FIG. 2, bracket 5 is shown as comprising a first section 9 attached to mast M, and a second section 11 supporting antenna whips 3, 6, 7 and 8. The attachment of section 9 to mast M is accomplished with the assistance of a threaded U-bolt 13 which extends around mast M and through bolt holes 14 (FIG. 3), bolt 13 being secured on mast M by means of nuts 15.

Figure 5:
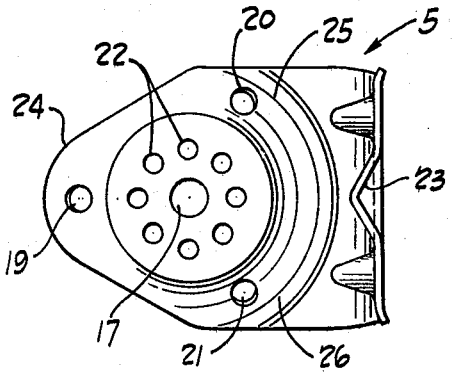
FIG. 5 is a bottom plan view of the bracket shown in FIGS. 3 and 4.

Second section 11 of bracket 5 includes a central opening 17 and three other openings 19–21 (FIG. 5) which are disposed radially from opening 17 and equi-angularly spaced from each other. Also spaced radially from opening 17 are a plurality of equi-angularly spaced bolt holes 22 whose function is explained hereinafter. Section 9 is contoured such as by bending to define a channel 23 for engaging a portion of the length of mast M to improve the force with which section 9 engages mast M.

Bracket 5 is preferably a unitary structure, and section 11 is accordingly shown as being a bent section transversely and generally perpendicularly to section 9. Section 11 is generally planar in the area surrounding opening 17 and holes 22, but includes ears 24–26 around openings 19–21 bent upwardly a predetermined amount relative to the foregoing planar central area to render the axes of openings 19–21 inclined relative to the vertical by the same angle $\phi$, $\phi$ being 15° according to the preferred embodiment.

Upper antenna whip or element 3 in its preferred form comprises an elongated fiberglass structure (the term fiberglass as used herein including fiberglass-/polyester compositions) which supports a conductive material such as copper wire. Whip 3 has a free upper end which can be provided with an appropriate tip, and a base portion comprising a ferrule 27 fabricated from brass or other conductive material. Ferrule 27 has a threaded lower end portion for receiving the internally threaded coupling member 29 of a coaxial cable 31. The construction of antenna whip 3 is such that the conductive element therein is electrically insulated from bracket 5, but electrically connected to the central conductor of coaxial cable 31 by virtue of the means by which coaxial cable 31 is coupled to whip 3. The manner of such coupling and electrical connection is well known in the art.

Lower antenna whips or radials 6–8 are similarly constructed from fiberglass and have elongated constructions in which conductive elements such as copper wire are supported. Antenna elements 6–8 terminate respectively in ferrules 32–34 which are constructed similarly to ferrule 27. Each ferrule 32–34 is electrically connected to the respective conducting elements in antenna whips 6–8 and to bracket 5; similarly, the conductive sheath of coaxial cable 31 is electrically connected to bracket 5 and to the foregoing conductive elements whereby the conductive elements are electrically connected to the sheath. In this regard, a metal conductive support plate 35 is bolted to bracket 5 by conductive bolts 37 extending through bolt holes 22, and an electrical connection between the sheath of cable 31 with plate 35 effects the ultimate grounded electrical connection with the conductive elements in the downwardly extending antenna whips.

Turning specifically to support bracket 5 as shown in FIGS. 3–6, bracket 5 is shown as comprising an integral metal part having been formed by an appropriate process such as in a stamping press, to define first and second sections 9 and 11, channel 23, and ears 24–26. The various holes and openings are preferably punched into the workpiece blank prior to the forming process. The construction of bracket 5 is extremely simple and economical, and when compared with corresponding prior art components, will be seen to represent a significant advancement over the prior art.

An antenna according to the preferred embodiment is particularly useful as a one-half wavelength, center-fed, omnidirectional dipole antenna with an impedance match for a standard 52-ohm coaxial cable. Whereas most center-fed antennas carry a 75-ohm impedance, the foregoing antenna accomplishes the lower impedance match by having the three lower radial elements be inclined by an angle (shown as being 15°) off the vertical when the support bracket is oriented as shown. The three illustrated lower antenna elements are spaced 120° apart to provide a nearly perfect, 360° colinear radiation pattern. The central disposition of the support bracket provides excellent balance for the antenna to resist external forces such as wind. The foregoing construction, when used for citizens band operation or similar applications, can be of extremely light weight, the preferred embodiment weighing less than 3 pounds. When the antenna is used as a one-half wavelength antenna, the length of the respective antenna elements are one-quarter wavelength.

The invention has been described in detail with particular reference to the preferred embodiment thereof, but variations and modifications within the spirit and scope of the invention may occur to those skilled in the art to which the invention pertains.

I claim:

1. A base station antenna comprising:

a bracket including a first section for attachment to an external support; and a second section transverse to said first section, said second section having top and bottom sides, a flattened central portion having a central opening for receiving the base portion of an upwardly extending first antenna whip, and a peripheral portion around the central portion and having a plurality of other openings spaced radially from said central opening for receiving the base portions of a plurality of downwardly extending second antenna whips, said peripheral portion being inclined to render second antenna whips received in said other openings inclined downwardly and outwardly from a first antenna whip received in said central opening;

a first antenna whip having a base portion including means for mounting said first antenna whip in said central opening, said first antenna whip extending from the top side of said second section in an upward direction; and a plurality of second antenna whips, each having a base portion including mounting means for mounting said second antenna whips in said other openings, said second antenna whips extending downwardly and outwardly from the bottom side of said second section.

2. The invention according to claim 1 wherein said antenna is a one-half wavelength antenna, and said antenna whips are each generally one-quarter wavelength long.

3. The invention according to claim 1 wherein said mounting means of said first antenna whip comprises a mounting ferrule for extending through said central opening of said bracket, and said antenna comprises a connector for electrically coupling a coaxial cable to said first antenna whip.

4. The invention according to claim 1 wherein said second antenna whips are three in number, and said peripheral portion is inclined to render antenna whips received in said radially disposed openings at a uniform angle of 15° relative to the first antenna whip.

5. The invention according to claim 1 wherein said bracket comprises an integral member.

6. The invention according to claim 5 wherein said bracket is fabricated from sheet metal.

7. The invention according to claim 1 wherein said first section comprises a vertical section configured to engage the surface of a vertical support mast, and said second section is generally perpendicular to said first section.

8. The invention according to claim 1 wherein said bracket is fabricated from an electrically conductive metal, said mounting means of said first antenna whip comprises a mounting ferrule for electrically connecting said first antenna whip to the central conductor of a coaxial cable having a central conductor and a conductive sheath, and for electrically insulating said first antenna whip from said bracket, and the mounting means of said second antenna whips comprise means for electrically connecting said second antenna whips to said bracket; and wherein said antenna further comprises coupling means for electrically connecting said bracket to the sheath of the coaxial cable.

9. The invention according to claim 1 wherein said antenna whips comprise fiberglass antenna elements carrying conductive material substantially along the length of the elements.

* * * * *